US010138638B1

(12) United States Patent
Deady

(10) Patent No.: US 10,138,638 B1
(45) Date of Patent: Nov. 27, 2018

(54) DECK COVERING SYSTEM

(71) Applicant: Stephen Deady, Quincy, MA (US)

(72) Inventor: Stephen Deady, Quincy, MA (US)

( * ) Notice: Subject to any disclaimer, the term of this patent is extended or adjusted under 35 U.S.C. 154(b) by 0 days.

(21) Appl. No.: 15/642,725

(22) Filed: Jul. 6, 2017

(51) Int. Cl.

| | |
|---|---|
| ***E04D 13/18*** | (2018.01) |
| ***E04F 15/02*** | (2006.01) |
| ***E04B 1/00*** | (2006.01) |
| ***E04F 15/10*** | (2006.01) |
| ***E04F 19/02*** | (2006.01) |
| ***F21V 33/00*** | (2006.01) |
| ***F21S 4/20*** | (2016.01) |
| ***F24D 13/02*** | (2006.01) |
| *F21Y 115/10* | (2016.01) |

(52) U.S. Cl.
CPC ..... *E04F 15/02183* (2013.01); *E04B 1/003* (2013.01); *E04F 15/105* (2013.01); *E04F 19/02* (2013.01); *F21S 4/20* (2016.01); *F21V 33/006* (2013.01); *F24D 13/02* (2013.01); *F21Y 2115/10* (2016.08)

(58) Field of Classification Search
CPC .. E04B 1/003; E04C 3/29; E04C 3/292; E04F 15/02183; E04F 15/02194; Y10T 428/24174
USPC ..... 52/716.1, 716.2, 177, 179, 650.3, 741.3, 52/97, 834, 836, 309.1, 825; 428/119
See application file for complete search history.

(56) References Cited

U.S. PATENT DOCUMENTS 5,280,692 A 1/1994 Patey
5,642,592 A * 7/1997 Andres ..... E04B 5/026 114/266
5,913,784 A * 6/1999 Hite ..... E01C 5/22 52/177
6,108,992 A * 8/2000 Shaw ..... E01B 1/70 52/177
6,393,632 B1 * 5/2002 Epple ..... E04H 4/101 4/502
6,955,021 B2 * 10/2005 Thomas ..... E04F 15/02183 52/510
7,449,231 B2 11/2008 Kang et al.
7,503,146 B2 * 3/2009 Thomas ..... E04F 15/02183 52/177
7,673,425 B2 * 3/2010 Thomas ..... E04D 13/0445 52/177
9,080,289 B2 7/2015 Beck et al.
9,156,233 B2 10/2015 Dossche et al.
9,163,414 B2 10/2015 Meersseman et al.
9,382,717 B2 7/2016 Randjelovic
9,534,377 B2 * 1/2017 Lee ..... E04B 1/64
2002/0050004 A1 * 5/2002 Epple ..... E04H 4/101 4/502

(Continued)

FOREIGN PATENT DOCUMENTS

CA 2785734 7/2011
GB 2399834 A 9/2004

(Continued)

*Primary Examiner* — Chi Q Nguyen
(74) *Attorney, Agent, or Firm* — Lambert Shortell & Connaughton; Gary E. Lambert; David J. Connaughton, Jr.

(57) ABSTRACT

A deck covering system is provided. The deck covering system is designed to be installed on existing decks to provide a new working surface for decks that have begun to deteriorate, to provide additional protection to existing decks, to provide enhanced function and appearance to decks, and the like.

14 Claims, 5 Drawing Sheets

(56) References Cited

U.S. PATENT DOCUMENTS

| | | | | |
|---|---|---|---|---|
| 2004/0226252 | A1 | 11/2004 | Sheldon | |
| 2005/0178071 | A1* | 8/2005 | Wood | E04F 15/02 52/3 |
| 2005/0281986 | A1 | 12/2005 | Nam | |
| 2006/0156640 | A1* | 7/2006 | Thomas | E04F 15/02183 52/58 |
| 2006/0172118 | A1 | 8/2006 | Han et al. | |
| 2009/0181209 | A1 | 7/2009 | Zheng et al. | |
| 2009/0266010 | A1* | 10/2009 | Lomske | E04F 15/02044 52/173.1 |
| 2017/0362840 | A1* | 12/2017 | Paul | E04F 15/225 |

FOREIGN PATENT DOCUMENTS

| | | | |
|---|---|---|---|
| WO | 2005116362 | A1 | 12/2005 |
| WO | 2008092961 | | 8/2008 |

* cited by examiner

DECK COVERING SYSTEM

BACKGROUND OF THE INVENTION

Field of the Invention

The present invention relates generally to deck systems. More particularly the present invention relates to a system to be used to restore deck by providing an overlay system utilizing existing deck support.

Description of Related Art

Building deck provides a convenient outdoor space for building occupants. The deck elevates an area above the ground and provides a dedicated area for recreation and space use. Often, these decks are built from pressure treated wood. Pressure treated wood lasts for decades. It is impervious to insects, and highly resistance to weather conditions. However, sunlight does negatively impact pressure treated wood deck, and is a primary driver of its breakdown.

Often, during construction projects, pressure treated wood deck is removed despite being in operational condition. Frequently, this removal is because the sun-facing surfaces are beginning to visually deteriorate, although the structural soundness of the deck has not decreased. This leads to unnecessary waste, and added consumer cost.

Therefore, what is needed is a system for restoring structurally sound pressure treated deck, primarily by resurfacing sun-facing surfaces and utilizing existing deck structure for support.

SUMMARY OF THE INVENTION

The subject matter of this application may involve, in some cases, interrelated products, alternative solutions to a particular problem, and/or a plurality of different uses of a single system or article.

In one aspect, a deck covering system is provided. The system has a deck covering which. The deck covering is substantially continuous across its surface and is configured to cover a building deck. The system further has a coping. The coping is configured to connect to the deck covering and configured to connect to the existing building deck about a perimeter of the building deck. The coping has a downwardly extending portion that is configured to fit over an edge of the building deck.

In another aspect, a deck is provided being retrofitted with the inventive deck covering system. The deck is formed of an approximately horizontal base and a support system. A deck covering is positioned over the deck base. A coping is positioned about a perimeter of the deck base, and is connected to the deck covering and to at least one of the deck base and deck support system. This coping has a downwardly extending portion which extending over an edge of the deck base. In varying embodiments, the deck may be connected to a building, may stand alone away from a building, be integrated into a building, and the like, without straying from the scope of the present invention.

DETAILED DESCRIPTION

Figure 1:
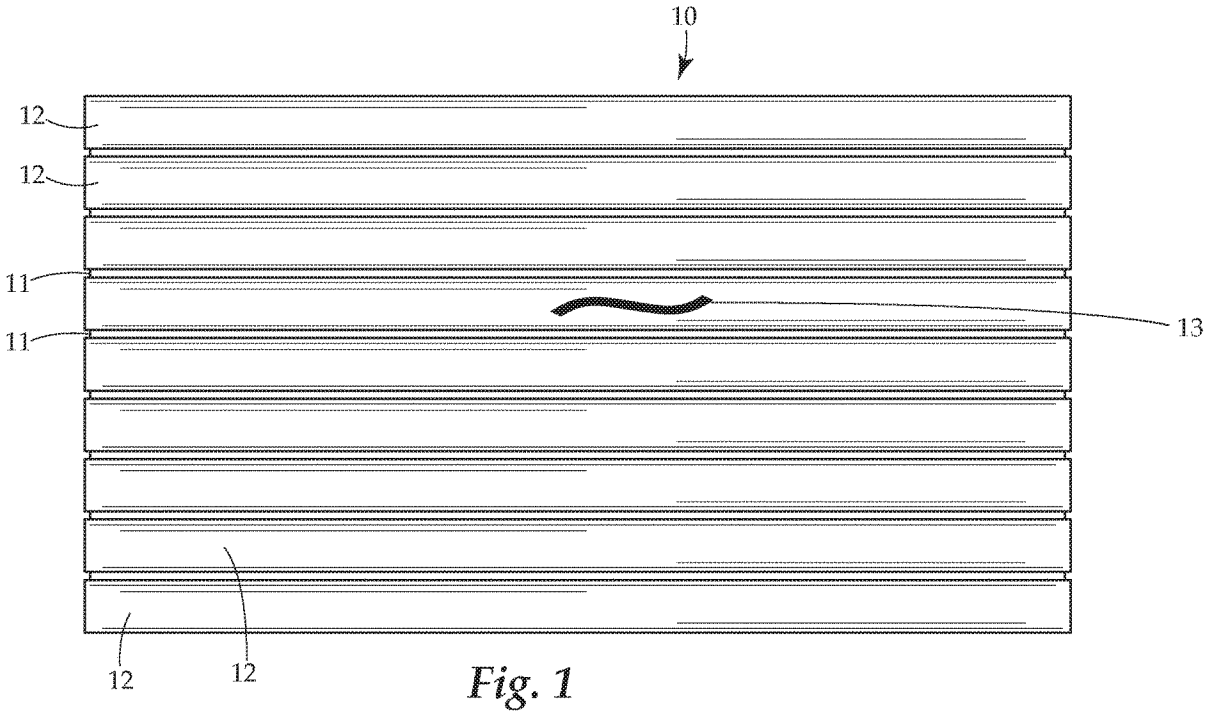
FIG. 1 provides an elevation view of an embodiment of the present invention.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns a system for covering and/or encapsulating an existing wooden deck structure. The system includes a deck covering to cover all or a portion of the primary horizontal portion of the deck. Further, the system may include optional drainage channels and related structure, fascia board for covering all or a portion of the side of the deck, coping for the edge of the deck and/or corner of the deck, rubber inserts for various covering and design purposes, lighting and/or heating structures connecting to or integrated into the system, and the like. The present invention may also include corresponding structure to cover and/or encapsulate stairs leading to and from the deck. The term deck is used herein to refer to any structures and assemblies that are outdoors, either covered or uncovered, that have at least part of their structures defining an approximately horizontal platform.

The deck covering and any various components contemplated herein may be formed of any material capable of covering the existing horizontal deck. In one embodiment, the deck covering may be formed of a plastic material such as HDPE, polyethylene, composite materials, and the like. In another embodiment, the deck covering may be multiple layered, including a base plastic layer, as well as board layers on top of the base layer which are arranged as a plurality of elongate panels which are spaced apart from each other. This embodiment allows for an appearance of a deck, and also facilitates drainage. Depending on embodiment, the deck covering may be attached to the deck, or may float on top, or may be secured in place by connection to other system components which are attached to the deck structure.

Drainage channels may be formed in any area on the deck covering that may facilitate proper drainage of the deck system. In one embodiment, a drainage channel may extend about a perimeter of the deck covering. In other embodiments, the drainage channel may extend into a part of the deck covering. In some embodiments, the drainage channels may be structurally separate from the deck covering to be connectable to the deck covering and any optional coping or fascia, or existing deck. In other embodiments, the drainage channels may be integrally formed with the deck covering, and similarly may be optionally attachable to other structural components.

Fascia board may be incorporated into the system in some embodiments to cover side portions of the deck. The fascia board may be formed of any material capable of covering a deck. Generally, as with the other deck covering system components, this is a plastic or composite material. In one embodiment, the fascia board may be directly attached to the side portion of the deck by, for example, nails, screws, brackets, adhesive clamps, and the like. Similarly, the fascia board may, in some embodiments, connect to the deck covering, either via a coping, as discussed below, or directly to the deck covering. In particular embodiments, the fascia may be formed with a connection structure to fit to the coping or deck covering, which may have corresponding connection structures (snap fit, hinge, dovetail, tongue and groove, among other non-limiting examples).

A coping may be positioned around a perimeter of the deck area. The coping may be used to join the deck covering structure to the existing deck structure, and/or to the fascia on the side of the deck. In some embodiments, the coping may be separated from the deck covering by a drainage channel. In some embodiments, the coping may lay flat on the edge of the existing deck surface, and may also bend downward to create a bull nose. In one embodiment, the fascia, when used, may attach to a downward facing surface of the coping that extends beyond the existing deck surface.

Various lighting and/or heating structures may be integrated into the deck covering system. This lighting may be on any portion of the system, in the form of any lighting source. For example, the lighting may be in the form of LED strips that extend along a portion of the system. A heating device may be positioned along part or all of the deck covering surface. This structure may allow the deck to be warmer than ambient temperature, to melt ice and snow, and to provide a more pleasant outdoor experience in cold weather.

Overall, the present deck covering system provides multiple options for covering and/or encapsulating existing deck or deck support. This allows a substantial extension in the life of the deck, as well as providing the ability for a new deck look and feel.

Figure 2:
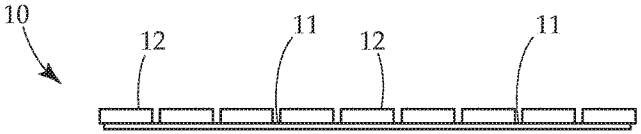
FIG. 2 provides a side view of an embodiment of the present invention.

Turning now to FIGS. 1 and 2, an elevation view and side view, respectively, of an embodiment of the deck covering is provided. In this embodiment, the deck covering 10 is formed of two layers, a base layer 11, and a paneling layer. The paneling layer is formed of a plurality of spaced apart elongate panels 12 such as boards. These may be integrally formed with the base layer 11, or attached thereto. The spaces between the panels 12 allow for traction, drainage, appearance of a traditional deck, and the like. Heater 13 can be seen connected to one of the panels 12 in this view.

Figure 3:
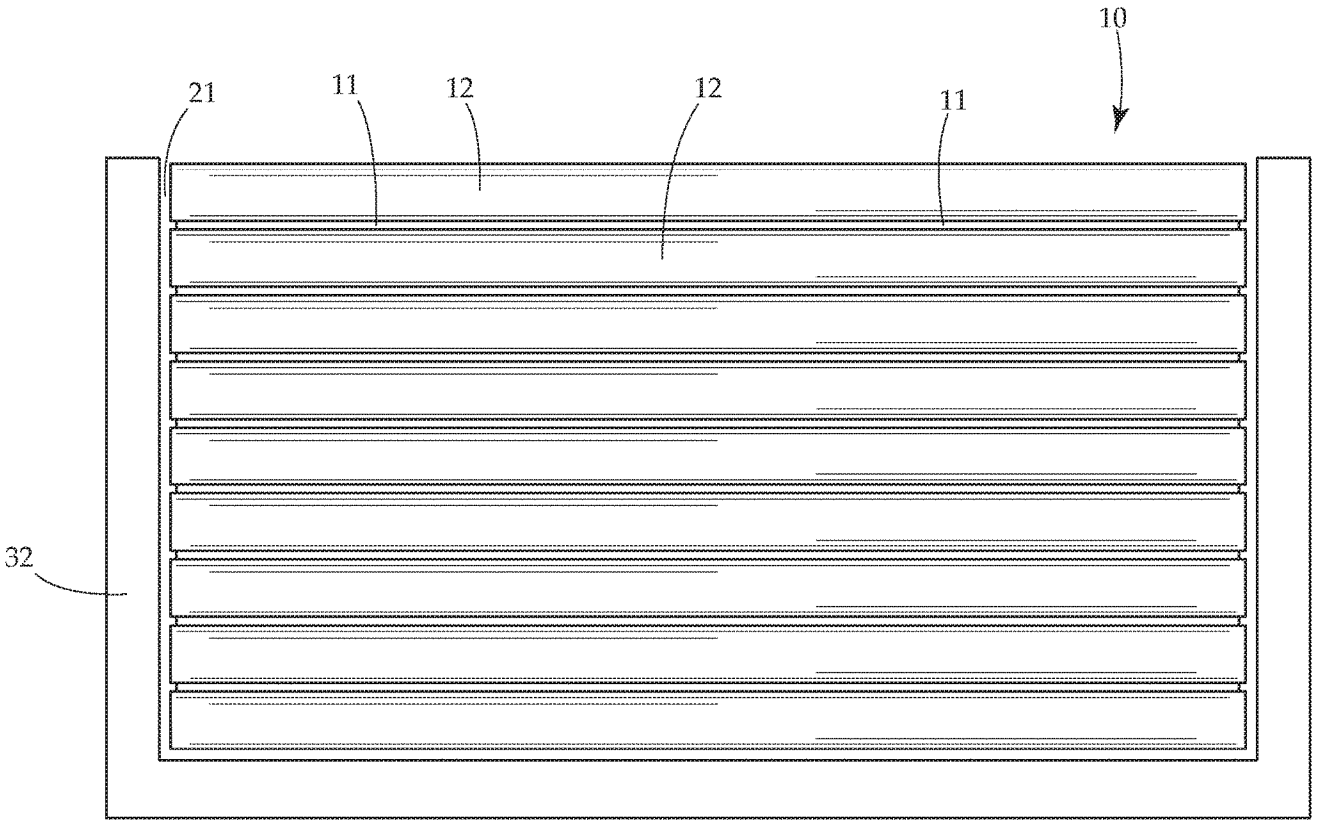
FIG. 3 provides an elevation view of another embodiment of the present invention.

FIG. 3 provides an elevation view of a further embodiment of the present invention. In this view, the deck covering 10 is used to cover most or all of an existing deck, which is attached or adjacent to a building structure. A drain channel insert 21 is disposed about a perimeter of the deck covering 10. In this embodiment, the drain channel 21 is formed as an insert connected to the covering 10, though this may vary depending on embodiment. On an opposite side of the drain channel 21 from the deck covering 10 is coping 32. Coping 32 is positioned about an edge of the deck and in some embodiments, may extend downwardly over an edge of the deck. Coping 32, in various embodiments, may connect directly to the deck, connect to the drain channel 21, and/or to the deck covering 10.

Figure 4:
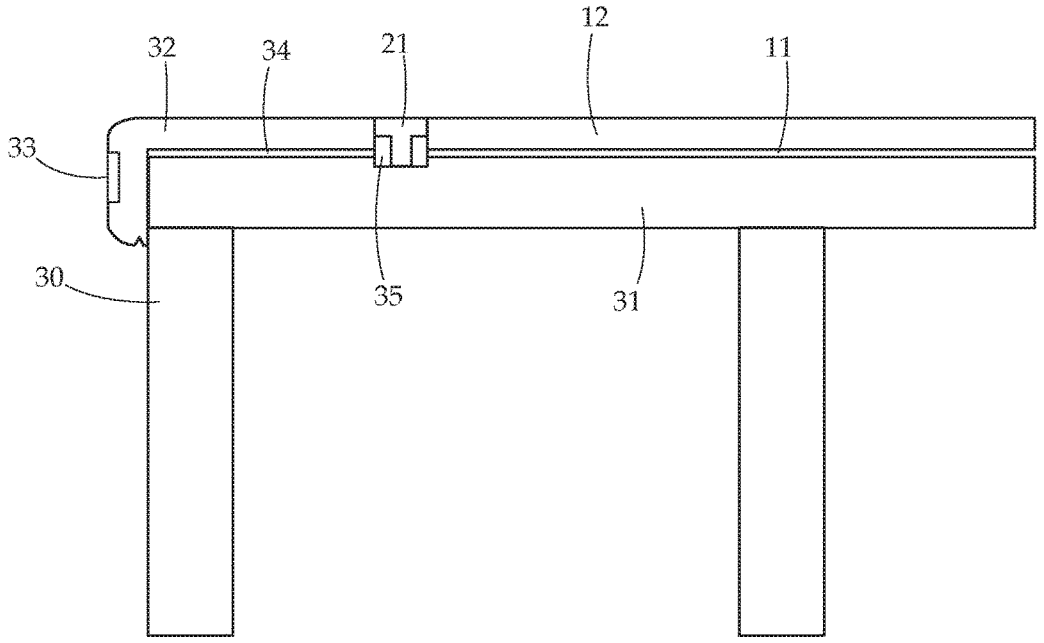
FIG. 4 provides a side view of another embodiment of the present invention.

A side view of an embodiment of that of FIG. 3 is shown in FIG. 4. Here, the drain channel 21 can be seen to have a grommet 35 positioned within it to facilitate draining, allowing water and other fluids to drain below the deck. Further, in this particular embodiment, the coping 32 has a bottom layer 34 which directly contacts the existing deck surface 31. Existing deck surface 31 is overlaid by both the surface covering 10 comprising the base layer 11 and panels 12, drain channel 21, and coping 32. The existing deck surface 31 is further supported by beams 30, as is known in the art. A portion of the coping 32 extends downwardly over an end of the deck surface 31. Connectors (not shown) may connect coping to the deck surface 31, and may be covered by strip 33.

Figure 5:
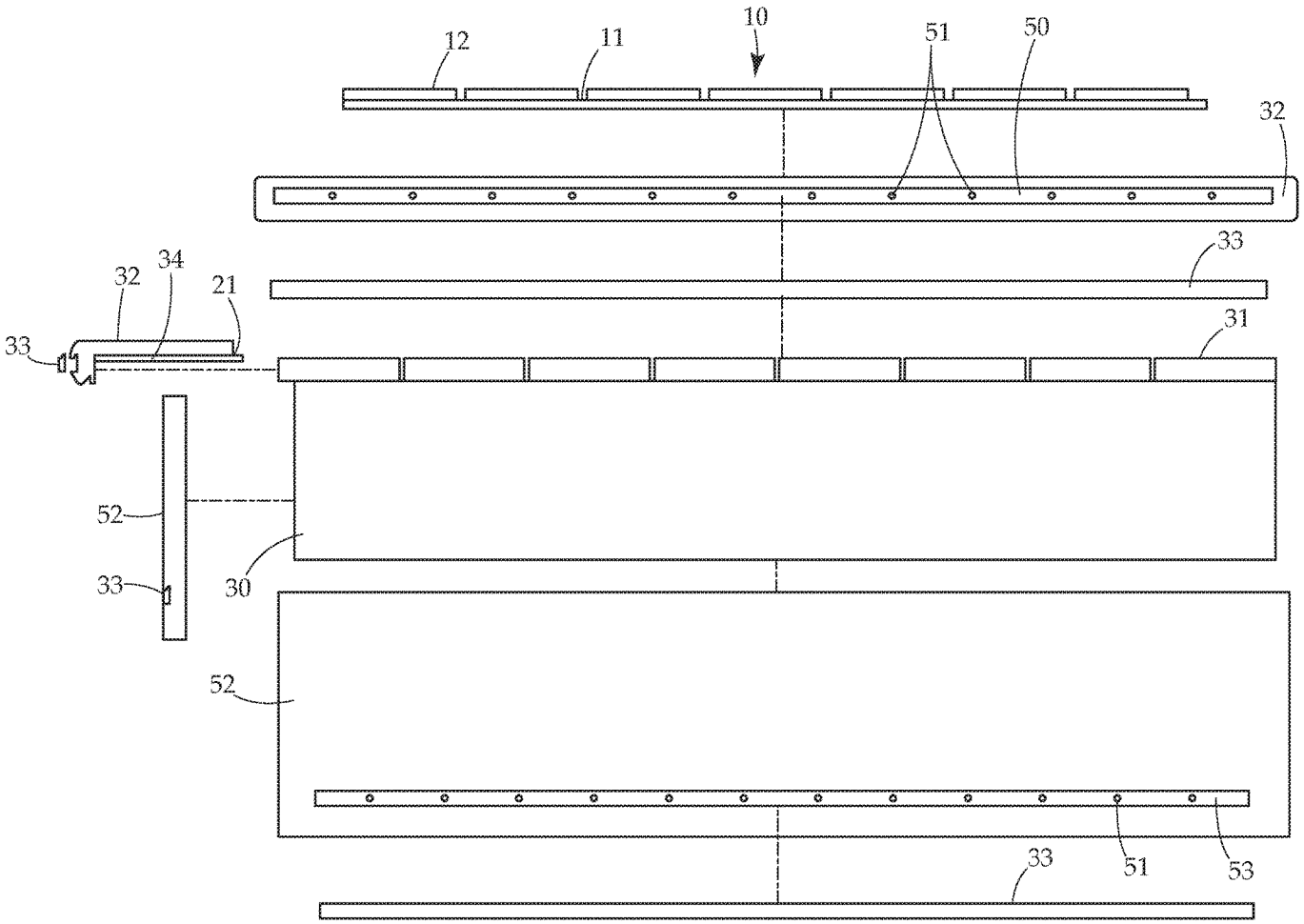
FIG. 5 provides an exploded view of yet another embodiment of the present invention.
Figure 6:
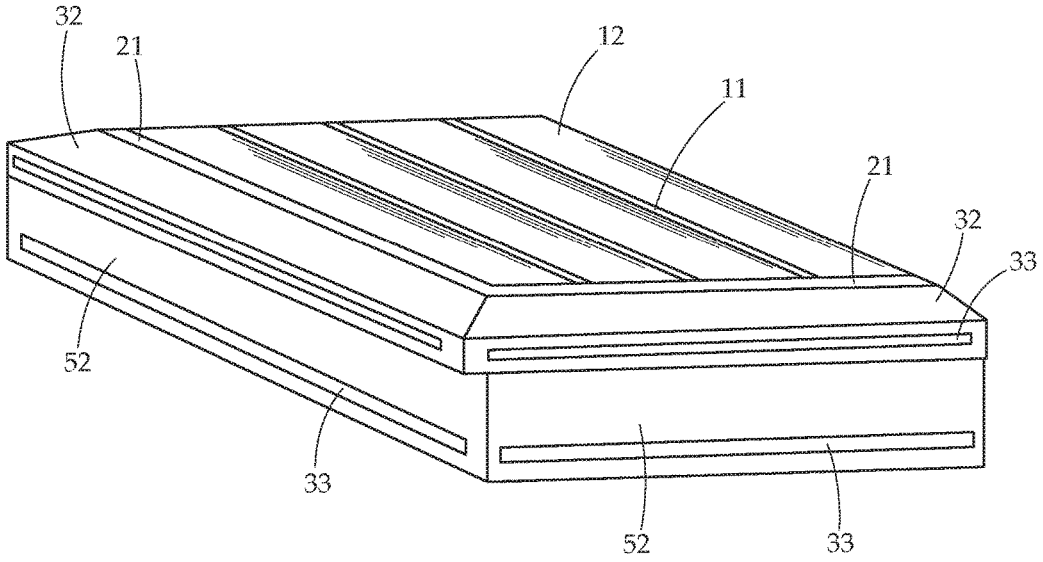
FIG. 6 provides a perspective view of yet another embodiment of the present invention.

FIGS. 5 and 6 provide an exploded view and perspective view, respectively of an embodiment of the present invention including a deck covering, coping, and also fascia, the fascia covering the side portions of the existing deck. The deck covering 10 includes a base layer 11 and panels 12. Coping 32 is seen in the side view and also front view. In this view, a connector area 50 is defined by the coping 32. The connector area is formed as a recessed area in the coping 32, and forms apertures 51 or generally provides an area for passing screws, nails, or the like into the existing deck 31 and/or 30. Strip 33 can fit into the connector area 50 to cover it and provide an even finish. In some embodiments, this strip 33 may comprise lighting to provide ambient lighting to the deck area.

Fascia 52 is shown in front and side views. The fascia may be formed of any material, but is typically formed of the same or similar materials as the coping and deck covering—that is, plastics and/or composite materials. In this embodiment, the fascia 52 is approximately the same size, or slightly larger than the deck beams 30. Fascia 52, when attached, may be connected to, abut, or be spaced apart from the coping 32. Typically, the fascia 52 and coping 32 will be in contact if not connected, however. The fascia 52 in this view has a connector area 53. In this embodiment, the connector area is formed as a recessed area in the coping 32, and may form apertures 51 or generally provide an area for passing screws, nails, or the like into the existing deck 31 and/or 30. Strip 33 can fit into the connector area 53 to cover it and provide an even finish. In the embodiment of FIG. 6, the coping 32 extends over the fascia 52, which is connected to the beam 30.

The deck covering system of the present invention may be used in any number of various ways and conditions. In many cases, the deck covering may be attached to an existing building deck. For example, the building deck may be old, and suffering deterioration from weather exposure, despite having a fully stable structure. In such a condition, the deck covering system may be applied to the deck to bring it back to a restored finish. Depending on the needs of the user, the decking system may include just the deck covering for direct connection to the deck, may float on top of the deck and be connected to the deck by coping which is attached directly to or hooks onto the deck, may also use fascia to cover sides of the deck, and the like. The components may be formed of pre-sized materials custom made to fit the deck, or may come in prefabricated sizes and may be cut or otherwise modified to fit. Installation may be performed by a lay-user or specialized technician.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A deck covering system comprising:

a deck covering configured to cover an existing building deck, the deck covering being substantially continuous across a surface, wherein the deck covering comprises a base layer, and a plurality of elongate panels on a top of the base layer, each of the plurality of elongate panels spaced apart from the other of the plurality of elongate panels forming a spacing between each of the plurality of elongate panels; and a drainage channel insert connected to at least two edges of the base layer, the drainage channel insert allowing fluid drainage away from the deck covering, and connected to the at least two edges of the base layer such that the spacing between each elongate panel is in communication with the drainage channel;

a coping, the coping being an elongate panel connected to the drainage channel insert on an opposite side to the drainage channel insert and base layer connection, and the coping configured to connect to the building deck about a perimeter of the building deck, the coping having a downwardly extending portion configured to fit over an edge of the building deck.

2. The deck covering system of claim 1 further comprising a heating device, the heating device in communication with at least a portion of the deck covering and configured to provide heating to the deck covering.

3. The deck covering system of claim 1 further comprising a fascia, the fascia configured to be adjacent to a bottom of the coping, and configured to be attached to a side of the existing building deck.

4. The deck covering system of claim 3 wherein the coping is configured to extend beyond the fascia when both are attached to the deck, the system further comprising a lighting strip, the lighting strip positioned on a bottom of the coping and directed at the fascia.

5. The deck covering system of claim 1 wherein the coping further comprises a connector area formed as a recessed area and defining a plurality of apertures through which a connector may pass to connect the coping to the building deck.

6. The deck covering system of claim 5 further comprising a covering strip configured to frictionally fit into the recessed area of the coping.

7. The deck covering system of claim 6 wherein the strip is an LED strip.

8. The deck covering system of claim 1 further comprising an illumination area, the illumination area positioned on at least one of the coping and the deck covering and configured to provide electrical lighting.

9. The deck covering system of claim 1 wherein the deck covering and the coping are formed of a plastic material.

10. A deck assembly comprising:

a deck connected to or adjacent to a building, the deck base being approximately horizontal;

a deck support structure configured to support the deck base;

a deck covering positioned over the deck base, the deck covering being substantially continuous across a surface wherein the deck covering comprises a base layer, and a plurality of elongate panels on a top of the base layer, each of the plurality of elongate panels spaced apart from the other of the plurality of elongate panels forming a spacing between each of the plurality of elongate panels;

a drainage channel insert connected to an edge of the base layer, the drainage channel insert configured to allow fluid drainage away from the deck covering, and connected to the edge of the base layer such that the spacing between each elongate panel is in communication with the drainage channel;

a coping, the coping being an elongate panel connected to connected to the drainage channel insert on an opposite side to the drainage channel insert and base layer connection, and the coping connected to at least one of the deck and the deck support about a perimeter of the deck, the coping having a downwardly extending portion extending over an edge of the deck;

a fascia, the fascia being adjacent to a bottom of the coping, and attached to at least one of a side of the deck base and the deck support.

11. The deck assembly of claim 10 further comprising a drainage channel positioned between the deck covering and the coping, the drainage channel configured to allow fluid drainage away from the deck covering, and wherein the deck covering comprises a base layer, and a plurality of elongate panels on a top of the base layer, each of the plurality of elongate panels spaced apart from the other of the plurality of elongate panels forming a spacing between each, such that the spacing between each elongate panel is in communication with the drainage channel.

12. The deck assembly of claim 10 wherein the coping extends beyond the fascia, and further comprising a lighting strip, the lighting strip positioned on a bottom of the coping and directed at the fascia.

13. A building comprising:

a deck, the deck comprising:

a deck base connected to or adjacent to a building, the deck base being approximately horizontal;

a deck support structure configured to support the deck base;

a deck covering positioned over the deck base, the deck covering being substantially continuous across a surface wherein the deck covering comprises a base layer, and a plurality of elongate panels on a top of the base layer, each of the plurality of elongate panels spaced apart from the other of the plurality of elongate panels forming a spacing between each of the plurality of elongate panels;

a drainage channel insert connected to an edge of the base layer, the drainage channel insert configured to allow fluid drainage away from the deck covering, and connected to the edge of the base layer such that the spacing between each elongate panel is in communication with the drainage channel;

a coping, the coping being an elongate panel connected to connected to the drainage channel insert on an opposite side to the drainage channel insert and base layer connection, and the coping connected to at least one of the deck base and the deck support about a perimeter of the deck, the coping having a downwardly extending portion extending over an edge of the deck base; and a fascia, the fascia being adjacent to a bottom of the coping, and attached to at least one of a side of the deck base and the deck support.

14. The building of claim 13 wherein the coping extends beyond the fascia, and further comprising a lighting strip, the lighting strip positioned on a bottom of the coping and directed at the fascia.

* * * * *